US006394932B1

(12) United States Patent
Chu

(10) Patent No.: US 6,394,932 B1
(45) Date of Patent: May 28, 2002

(54) SECTIONAL HORIZONTAL BAR CONVERTIBLE INTO PARALLEL BARS

(76) Inventor: Walt Chu, 7F, No. 29-3, Sec 4, Jen-Ai Road, Taipei (TW)

( * ) Notice: Subject to any disclaimer, the term of this patent is extended or adjusted under 35 U.S.C. 154(b) by 0 days.

(21) Appl. No.: 09/881,725

(22) Filed: Jun. 18, 2001

(51) Int. Cl.[7] ..... A63B 1/00

(52) U.S. Cl. ..... 482/38; 482/41; 482/34; 482/36; 482/37

(58) Field of Search ..... 482/23, 34, 35, 482/36, 37, 38, 41

(56) References Cited

U.S. PATENT DOCUMENTS

| | | | | | |
|---|---|---|---|---|---|
| 1,142,137 | A | * | 6/1915 | Bathrick | 482/41 |
| D160,419 | S | * | 10/1950 | Packer | 482/36 |
| D173,173 | S | * | 10/1954 | Rink | 482/36 |
| D176,999 | S | * | 3/1956 | Ahrens | 482/37 |
| 3,120,955 | A | * | 2/1964 | Carlin | 482/36 |
| 3,547,435 | A | * | 12/1970 | Scott | 482/35 |
| D227,792 | S | * | 7/1973 | Henning et al. | 482/36 |
| 4,278,250 | A | * | 7/1981 | Baynes et al. | 482/34 |
| 4,804,176 | A | * | 2/1989 | Goble | 482/35 |

* cited by examiner

*Primary Examiner*—Michael A. Brown
*Assistant Examiner*—Lori Baker Amerson
(74) *Attorney, Agent, or Firm*—Rabin & Derdo, P.C.

(57) ABSTRACT

A sectional horizontal bar mainly includes two H-shaped uprights, two A-shaped bar supports connected to upper ends of the uprights, two curved bases connected to lower ends of the uprights to extend forward and rearward from the uprights for the latter to stably stand, and a top bar connected at two ends to upper ends of the bar supports. A lower and an upper D-shaped support are pivotally connected to lower ends and upper portions of each upright to normally locate at outer sides of the two uprights. When the two D-shaped supports are pivotally turned to locate at inner sides of the two uprights, a user may grip with two hands at the two inward turned upper D-shaped supports to do exercises just as on parallel bars.

6 Claims, 3 Drawing Sheets

SECTIONAL HORIZONTAL BAR CONVERTIBLE INTO PARALLEL BARS

BACKGROUND OF THE INVENTION

The present invention relates to a sectional horizontal bar, and more particularly to a sectional horizontal bar that could be easily converted into parallel bars.

A conventional horizontal bar mainly includes two simple upright posts and a top bar horizontally supported on tops of the two posts. A user may grip at the top bar to do different exercises, such as pull up, swings, etc. For the entire horizontal bar to have sufficient strength and stability, it is a common practice to plant the two upright posts into ground by a proper depth and to weld the top bar to the posts. Such fixed type of horizontal bar is immobile and suitable for use outdoors.

And, a conventional pair of parallel bars mainly includes a plurality of upright posts and two bars parallelly supported on tops of the posts. A user may grip at the two bars to do different exercises, such as pull up, swings and the like to strengthen his or her arm muscles. As in the case of the conventional horizontal bar, the conventional parallel bars are usually immobile and cause inconveniences in use of them.

The horizontal bar and the parallel bars are structurally similar to one another. However, there has never been any product in the markets integrating these two items into one unit for users to conveniently do more exercises in a small space.

It is therefore desirable to develop a horizontal bar that could be used at any desired place and be quickly converted to function like a pair of parallel bars.

SUMMARY OF THE INVENTION

A primary object of the present invention is to provide a sectional horizontal bar that could be easily assembled and disassembled for convenient and safe use at any desired place.

Another object of the present invention is to provide a sectional horizontal bar that could be quickly converted to function like a pair of parallel bars.

To achieve the above and other objects, the present invention mainly includes two H-shaped uprights, two A-shaped bar supports connected to upper ends of the uprights, two curved bases connected to lower ends of the uprights to extend forward and rearward from the uprights for the latter to stably stand, and a top bar connected at two ends to upper ends of the bar supports. A lower and an upper D-shaped support are pivotally connected to lower ends and upper portions of each upright to normally locate at outer sides of the two uprights, so that the present invention functions like a horizontal bar and a user may grip with two hands at the top bar to do suitable exercises. When the two D-shaped supports are pivotally turned to locate at inner sides of the two uprights, a user may grip with two hands at the two inward turned upper D-shaped supports to do exercises just as on parallel bars.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
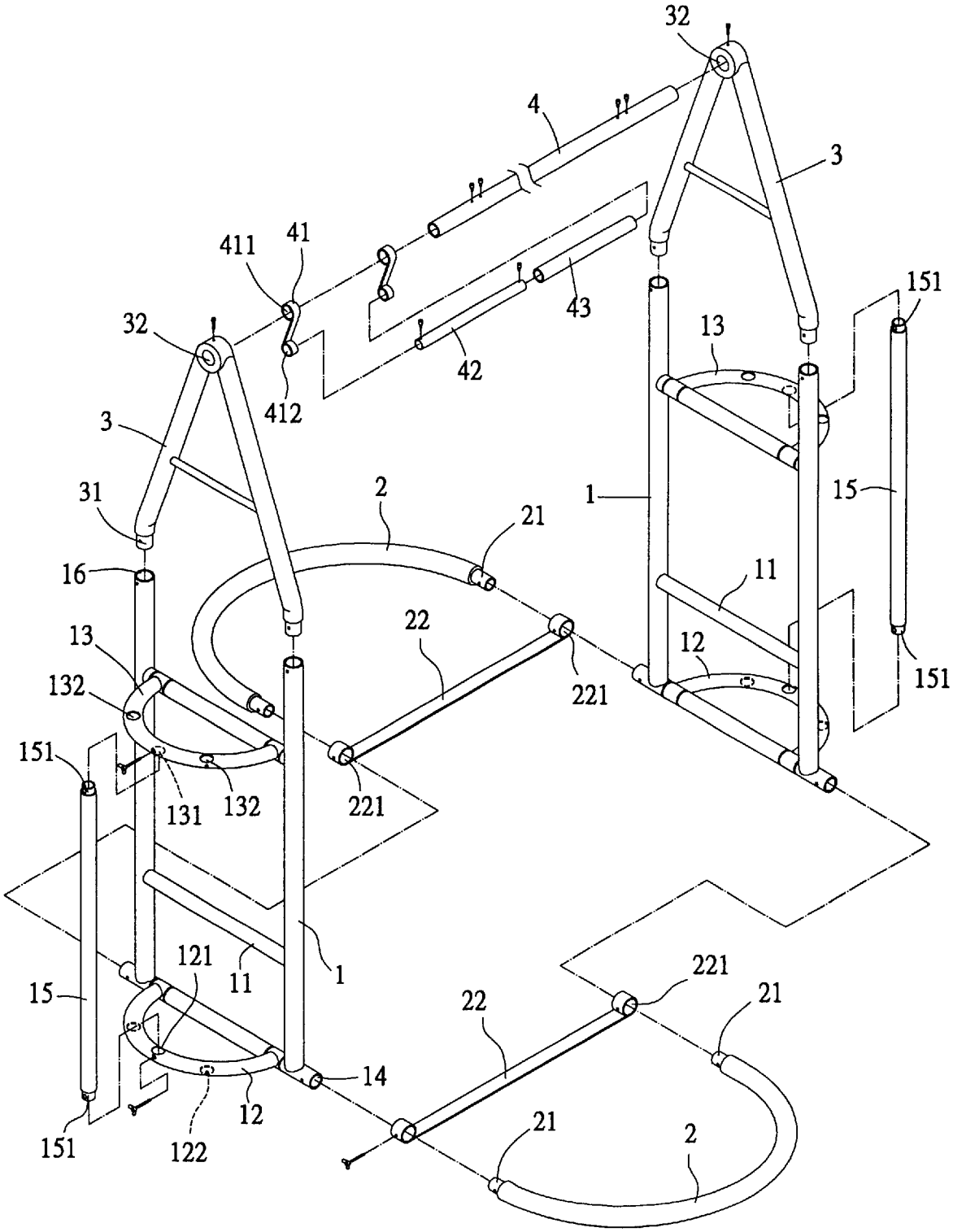
FIG. 1 is an exploded perspective view of a sectional horizontal bar convertible into parallel bars according to the present invention.

Please refer to FIG. 1 that is an exploded perspective view of a sectional horizontal bar convertible into parallel bars according to the present invention. As shown, the sectional horizontal bar mainly includes two symmetrical H-shaped uprights 1, two symmetrical curved bases 2 formed from two bent pipes, two symmetrical A-shaped bar supports 3, and a top bar 4.

The H-shaped upright 1 includes two upright posts 1 and a rail 11 transversely extended between the two upright posts 1 at a predetermined height. A lower and an upper support 12, 13 substantially in the shape of letter D are pivotally connected to two lower ends and two upper portions, respectively, of the two upright posts 1. A first insertion hole 121 is centered at one side of a curved portion of the lower support 12, and at least two second insertion holes 122 are formed at another side of the curved portion opposite to the first insertion hole 121 to locate at two sides of the first insertion hole 121; and a third insertion hole 131 is centered at one side of a curved portion of the upper support 13, and at least two fourth insertion holes 132 are formed at another side of the curved portion opposite to the third insertion hole 131 to locate at two sides of the third insertion hole 131, such that when the lower and the upper supports 12, 13 connected to one H-shaped upright 1 are pivotally turned to an outer side of the H-shaped upright 1 opposite to the other H-shaped upright 1, the first and the third insertion holes 121, 131 face toward each other while the second and the fourth insertion holes 122, 132 face away from one another, and when the lower and the upper supports 12, 13 connected to one H-shaped upright 1 are pivotally turned to an inner side of the H-shaped upright 1 facing toward the other H-shaped upright 1, the first and the third insertion holes 121, 131 face away from each other while the second and the fourth insertion holes 122, 132 face toward one another. A post-shaped brace 15 having two diametrically reduced ends 151 is adapted to mount between the lower and the upper support 12, 13 by engaging the two reduced ends 151 into the first and the third insertion holes 121, 131 or the second and the fourth insertion holes 122, 132.

The lower support 12 is connected to the H-shaped upright 1 with two ends of a straight portion thereof projected from two lower ends of the H-shaped upright 1 to provide two connection holes 14. Two upper ends of the H-shaped upright 1 also provide two connection holes 16.

The curved base 2 has two diametrically reduced ends 21 adapted to tightly fit into the connection holes 14. A connecting member 22 having two sleeves 221 provided at two ends is adapted to connect to two lower ends of the two H-shaped uprights 1 at the same side by engaging each sleeve 221 around the connecting holes 14 of the two lower supports 12 that are located at the same side, so as to space the two H-shaped uprights 1 by a fixed distance defined by the connecting member 22.

The A-shaped bar support 3 includes two spaced and diametrically reduced lower ends 31, and a converged upper end at where a connecting hole 32 is provided for receiving an end of the top bar 4 therein.

The top bar 4 is a straight bar. Two S-shaped metal hangers 41 providing an upper and a lower hole 411, 412 are provided at a middle portion of the top bar 4. The top bar 4 is extended through the upper holes 411 of the two hangers 41 with two ends received in the connecting holes 32 at the upper ends of the two bar supports 3. A grip bar 42 is held on the two S-shaped hangers 41 by engaging two ends with the two lower holes 412. A sleeve pipe 43 is fitted over the grip bar 42.

Figure 2:
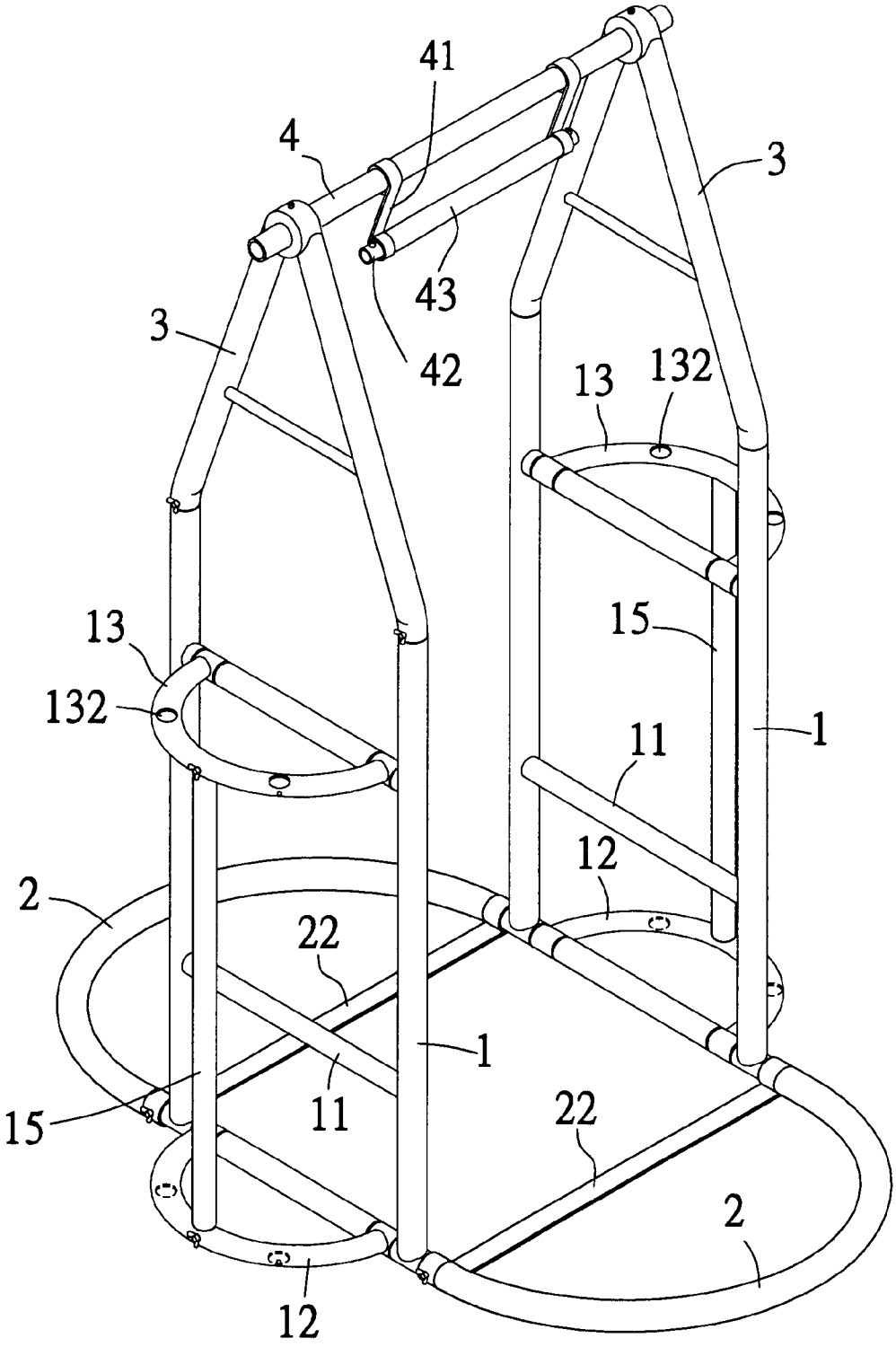
FIG. 2 is an assembled perspective view of the present invention for functioning like a horizontal bar.

FIG. 2 shows a horizontal bar assembled from the above-described components. To assemble the horizontal bar, first connect the two bar supports 3 to the two H-shaped uprights 1 by inserting the reduced lower ends 31 of the bar supports 3 into the connecting holes 16 at the upper ends of the uprights 1, and then extend the top bar 4 through the upper holes 411 of the two S-shaped hangers 41 before engaging two ends of the top bar 4 into the connecting holes 32 at the upper ends of the two bar supports 3. The grip bar 42 covered with the sleeve pipe 43 is then connected to the two lower holes 412 of the two hangers 41. Thereafter, connect two connecting members 22 to lower ends of the two uprights 1 with the projected ends of the two D-shaped lower supports 12 received in the sleeves 221 of the connecting members 22. The two curved bases 2 are then connected to the lower ends of the uprights 1 by inserting their reduced ends 21 into the connecting holes 14 provided at the projected ends of the D-shaped lower supports 12, such that the two curved bases 2 separately extend forward and rearward from lower ends of the two uprights 1 for the entire horizontal bar to have an increased contact area with a floor or ground on which the sectional horizontal bar is erected. The lower and the upper supports 12, 13 are turned to locate at outer sides of the two uprights 1 with the first and the third insertion holes 121, 131 facing toward one another. At this point, two braces 15 may be connected to the lower and the upper supports 12, 13 by inserting the reduced ends 151 of the braces 15 into the first and the third insertion holes 121, 131, so as to reinforce the two uprights 1 and allow the lower supports 12 to provided an enhanced side supporting effect to the whole horizontal bar. A user may grip with two hands at the sleeve pipe 43 to pull up or swing his or her body. The provision of the S-shaped metal hangers 41 to connect the grip bar 42 to the top bar 4 creates an unbalanced relation between a center of gravity of the user and a direction of force applied by the user. This arrangement allows automatic generation of a reverse action force when the user swings to and fro on the horizontal bar, enabling the user to swing more easily. Moreover, the sleeve pipe 43 over the grip bar 42 protects the user against pain or injury caused by continuous frictional contact with the grip bar 42 while swinging. The rails 11 are provided on the uprights 1 near a middle portion hereof and may serve as steps for a short user to step on and therefore more easily access the grip bar 42.

Figure 3:
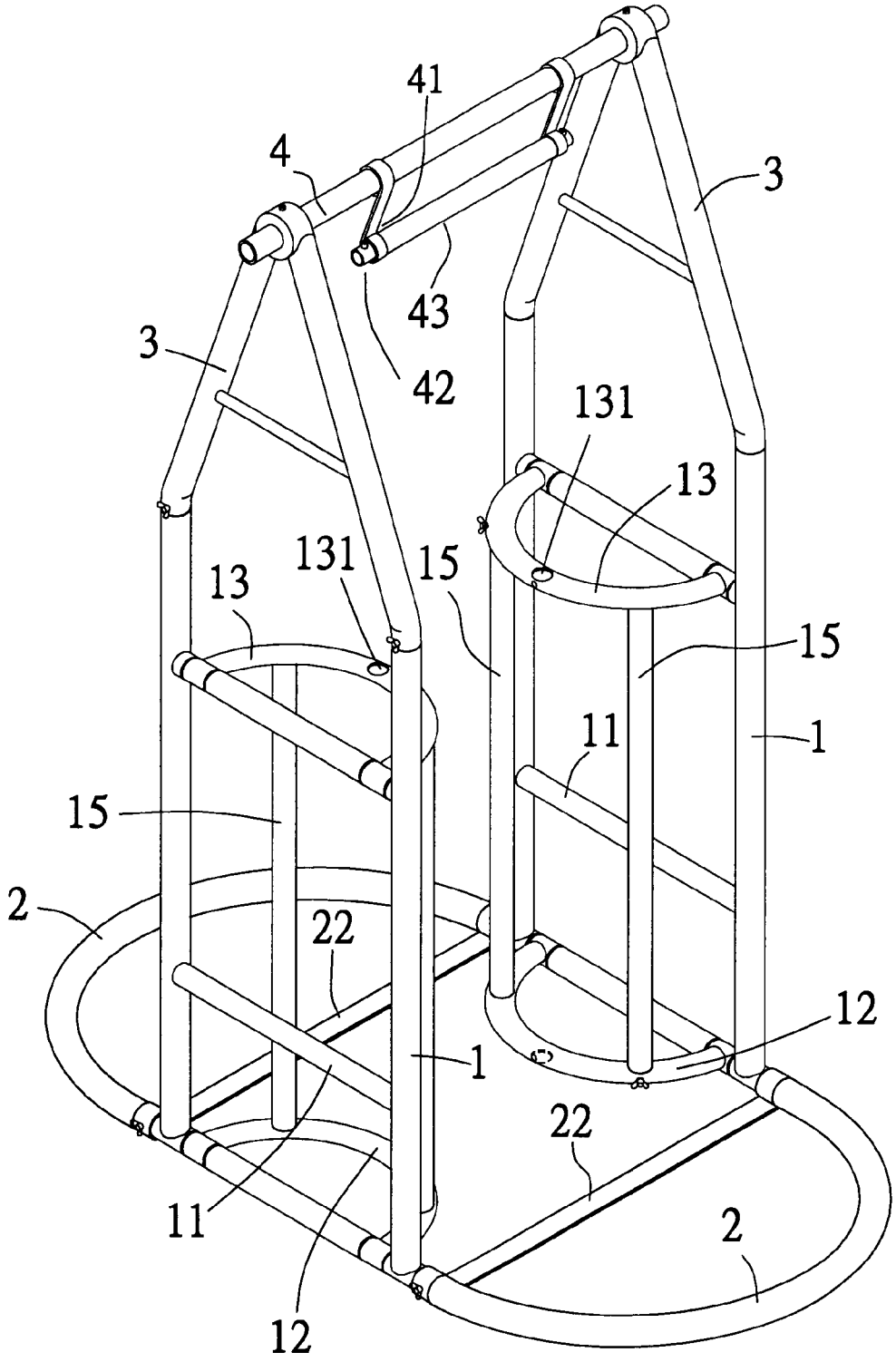
FIG. 3 is an assembled perspective view of the present invention for functioning like parallel bars.

The sectional horizontal bar of FIG. 2 may be quickly converted into a structure functioning like parallel bars, as shown in FIG. 3. To do this, simply remove the braces 15 from the first and the third insertion holes 121, 131 and pivotally turn the lower and the upper supports 12, 13 to an inner side of the uprights 1 to locate below the top bar 4, and then use additional braces 15 to support the inward turned lower and upper supports 12, 13 by inserting reduced ends 151 of the additional braces 15 into the second and the fourth insertion holes 122, 132. At this point, the curved portions of the two upper supports 13 are projected from the two uprights 1 toward each other to located below the top bar 4. A user may grip with two hands at the curved portions of the upper supports 13 just as on parallel bars to do some simple exercises.

To ensure firm and secure connection of the reduced ends 151, 21, 31 to the insertion holes 121, 122, 131, 132 and the connecting holes 14, 16, the reduced ends and the insertion holes and the connecting holes may be correspondingly provided with through holes or screw holes for pins or bolts, respectively, to extend therethrough.

What is claimed is:

1. A sectional horizontal bar convertible into parallel bars, comprising:

two symmetrical H-shaped uprights, each of which including two upright posts, a rail transversely extended between said two upright posts at a predetermined height, a lower and an upper support substantially in the shape of letter D pivotally connected to two lower ends and two upper portions, respectively, of said two upright posts, and connecting holes formed at lower ends and upper ends of said upright posts;

two symmetrical curved bases formed from bent pipes, each of which having two diametrically reduced ends adapted to insert into two of said connecting holes at the lower ends of said upright posts that are located at the same side, such that said two curved bases separately extend forward and rearward from lower ends of said two uprights to provide an increased contact area of said sectional horizontal bar with a floor;

two symmetrical A-shaped bar supports, each of which having two spaced and diametrically reduced lower ends for inserting into said connecting holes at upper ends of said H-shaped uprights, and a converged upper end at where a connecting hole is provided; and a top bar being supported on said two bar supports with two ends thereof received in said connecting hole at said converged upper ends of said bar supports, and two metal hangers being put on a middle portion of said top bar for holding a grip bar thereto;

whereby when said D-shaped lower and upper supports pivotally connected to said two H-shaped uprights are turned to outer sides of said uprights, a user may grip with two hands at said grip bar below said top bar to do exercises available on a horizontal bar; and when said D-shaped lower and upper supports are turned to inner sides of said uprights, a user may grip with two hands at said upper supports below said top bar to do exercises available on parallel bars.

2. The sectional horizontal bar convertible into parallel bars as claimed in claim 1, wherein each of said lower supports is provided at one side of a curved portion with a centered first insertion hole, and at another side of the curved portion opposite to said first insertion hole with at least two second insertion holes to locate at two sides of said first insertion hole; and each of said upper supports being provided at one side of a curved portion with a centered third insertion hole, and at another side of the curved portion opposite to said third insertion hole with at least two fourth insertion holes to locate at two sides of said third insertion hole; whereby when said lower and said upper supports are pivotally turned to outer sides of said two H-shaped uprights, said first and said third insertion holes face toward each other, and a post-shaped brace could be extended between said lower and said upper supports on each said upright with two reduced ends of said brace inserted into said first and said third insertion holes; and when said lower and said upper supports are pivotally turned to inner sides of said two H-shaped uprights, said second and said fourth insertion holes face toward one another, and at least two said braces could be extended between said lower and said upper supports by inserting said reduced ends of said braces into said second and said fourth insertion holes.

3. The sectional horizontal bar convertible into parallel bars as claimed in claim 1, wherein said metal hangers are substantially in the shape of a letter S to provide at two ends with upper and lower receiving holes; said top bar being extended through said upper receiving holes for said metal hangers to locate at a middle section of said top bar; and said grip bar being connected at two ends to said lower receiving holes of said S-shaped metal hangers.

4. The sectional horizontal bar convertible into parallel bars as claimed in claim 1, wherein said grip bar is covered with a sleeve pipe.

5. The sectional horizontal bar convertible into parallel bars as claimed in claim 3, wherein said grip bar is covered with a sleeve pipe.

6. The sectional horizontal bar convertible into parallel bars as claimed in claim 1, further comprises two long connecting members, each of which being provided at two ends with two sleeves adapted to receive therein two lower ends of said two H-shaped uprights that are located at the same side, so as to space said two H-shaped uprights by a fixed distance defined by said connecting members.

* * * * *